US011608477B1

(12) United States Patent
Garelick et al.

(10) Patent No.: US 11,608,477 B1
(45) Date of Patent: Mar. 21, 2023

(54) ENGINE OIL FORMULATIONS FOR LOW TIMING CHAIN STRETCH

(71) Applicant: AFTON CHEMICAL CORPORATION, Richmond, VA (US)

(72) Inventors: Ken Garelick, Mechanicsville, VA (US); Leslie Schmid, Richmond, VA (US); Kristi Engelman, Richmond, VA (US)

(73) Assignee: AFTON Chemical Corporation, Richmond, VA (US)

( * ) Notice: Subject to any disclaimer, the term of this patent is extended or adjusted under 35 U.S.C. 154(b) by 0 days.

(21) Appl. No.: 17/390,867

(22) Filed: Jul. 31, 2021

(51) Int. Cl.
*C10M 141/10* (2006.01)
*C10M 137/10* (2006.01)
(Continued)

(52) U.S. Cl.
CPC ..... *C10M 141/10* (2013.01); *C10M 129/50* (2013.01); *C10M 135/10* (2013.01); *C10M 135/18* (2013.01); *C10M 137/10* (2013.01); *C10M 169/04* (2013.01); *C10M 2203/003* (2013.01); *C10M 2207/141* (2013.01); *C10M 2219/044* (2013.01); *C10M 2219/068* (2013.01);
(Continued)

(58) Field of Classification Search
CPC ..... C10M 141/10; C10M 137/10; C10M 135/18; C10M 135/10; C10M 129/50; C10M 169/04; C10M 2203/003; C10M 2223/045; C10M 2219/068; C10M 2219/044; C10M 2207/141; C10N 2040/25; C10N 2030/041; C10N 2030/52; C10N 2030/45; C10N 2030/02
See application file for complete search history.

(56) References Cited

U.S. PATENT DOCUMENTS 3,634,515 A 1/1972 Piasek et al.
4,152,499 A 5/1979 Boerzel et al.
(Continued)

FOREIGN PATENT DOCUMENTS

EP 0612839 A1 8/1994
WO 94/06897 A1 3/1994

OTHER PUBLICATIONS

Li, Shoutian, et al. "Wear in Cummins M-11/EGR test engines." SAE Transactions vol. 111, Section 3: Journal of Engines (2002): 2258-2271.

(Continued)

*Primary Examiner* — Cephia D Toomer
(74) *Attorney, Agent, or Firm* — Mendelsohn Dunleavy, P.C.

(57) ABSTRACT

A lubricating oil composition and method for controlling timing chain stretch, wherein the composition contains greater than 50 wt. % of base oil, zinc dialkyl dithiophosphate(s) to provide 350-2200 ppm zinc, molybdenum-containing compound(s) to provide >1-3000 ppm molybdenum, and magnesium-containing detergent(s) to provide <2050 ppm magnesium, all based on the total weight of the composition. The composition has a total TBN of less than 7.5 mg KOH/g, measured by ASTM D-2896 and a weight ratio of ppm of zinc from zinc dialkyl dithiophosphate(s) to ppm of molybdenum from molybdenum-containing compound(s) of <10. The method employs the lubricating oil composition to control timing chain stretch to a level of 0.1% or less.

20 Claims, 2 Drawing Sheets

(51) Int. Cl.

| | |
|---|---|
| ***C10M 135/18*** | (2006.01) |
| ***C10M 135/10*** | (2006.01) |
| ***C10M 129/50*** | (2006.01) |
| ***C10M 169/04*** | (2006.01) |
| *C10N 40/25* | (2006.01) |
| *C10N 30/04* | (2006.01) |
| *C10N 30/00* | (2006.01) |
| *C10N 30/02* | (2006.01) |

(52) U.S. Cl.
CPC ..... *C10M 2223/045* (2013.01); *C10N 2030/02* (2013.01); *C10N 2030/041* (2020.05); *C10N 2030/45* (2020.05); *C10N 2030/52* (2020.05); *C10N 2040/25* (2013.01)

(56) References Cited

U.S. PATENT DOCUMENTS

| | | | | |
|---|---|---|---|---|
| 4,234,435 | A | | 11/1980 | Meinhardt et al. |
| 4,259,194 | A | | 3/1981 | deVries et al. |
| 4,259,195 | A | | 3/1981 | King et al. |
| 4,261,843 | A | | 4/1981 | King et al. |
| 4,263,152 | A | | 4/1981 | King et al. |
| 4,265,773 | A | | 5/1981 | deVries et al. |
| 4,272,387 | A | | 6/1981 | King et al. |
| 4,283,295 | A | | 8/1981 | deVries et al. |
| 4,285,822 | A | | 8/1981 | deVries et al. |
| 5,075,383 | A | | 12/1991 | Migdal et al. |
| 5,241,003 | A | | 8/1993 | Degonia et al. |
| 5,334,321 | A | | 8/1994 | Harrison et al. |
| 5,650,381 | A | * | 7/1997 | Gatto ..... C10M 159/24 508/364 |
| 5,739,355 | A | | 4/1998 | Gateau et al. |
| 5,883,057 | A | | 3/1999 | Roell, Jr. et al. |
| 6,048,831 | A | | 4/2000 | Mori |
| 6,107,257 | A | | 8/2000 | Valcho et al. |
| RE37,363 | E | | 9/2001 | Gatto et al. |
| 6,300,291 | B1 | | 10/2001 | Hartley et al. |
| 6,723,685 | B2 | * | 4/2004 | Hartley ..... C10M 163/00 508/365 |
| RE38,929 | E | | 1/2006 | Gatto et al. |
| 7,214,649 | B2 | | 5/2007 | Loper et al. |
| 7,253,231 | B2 | | 8/2007 | Devlin et al. |
| 7,368,596 | B2 | | 5/2008 | Thomson et al. |
| RE40,595 | E | | 12/2008 | Gatto et al. |
| 7,485,603 | B2 | | 2/2009 | Bera et al. |
| 7,572,200 | B2 | * | 8/2009 | Murata ..... F16G 13/06 474/202 |
| 7,645,726 | B2 | | 1/2010 | Loper |
| 7,732,390 | B2 | | 6/2010 | Kadkhodayan et al. |
| 7,786,057 | B2 | | 8/2010 | Bera et al. |
| 7,897,696 | B2 | | 3/2011 | Huang et al. |
| 2012/0101017 | A1 | | 4/2012 | Duggal |
| 2016/0326451 | A1 | * | 11/2016 | Esche ..... C10M 141/10 |
| 2018/0346839 | A1 | * | 12/2018 | Fletcher ..... C10M 169/042 |

OTHER PUBLICATIONS

Polat, Özay. "Investigation of Lubrication Effect on a Diesel Engine Timing Chain Wear." Doctoral Dissertation, Istanbul Technical University (2008): 1-77.

* cited by examiner

ENGINE OIL FORMULATIONS FOR LOW TIMING CHAIN STRETCH

TECHNICAL FIELD

The disclosure relates to lubricating oil compositions and, in particular, to lubricating oil additive compositions and methods for controlling timing chain stretch using lubricating oil compositions.

BACKGROUND

In an internal combustion engine, there may be a metal chain, also known as a timing chain, comprised of bearing pins, rollers, bushings, and an inner and outer plate. Due to the significant load and friction exerted on the timing chain, it is susceptible to significant wear including corrosive wear. To address this problem, lubricants are used to reduce wear between moving parts where there is metal to metal contact.

Chain elongation, or timing chain stretch, is a phenomenon that occurs in internal combustion engines with a timing chain that has deteriorated due to wear. Chain elongation mainly occurs at the pin, bushing and side plate wear contact interfaces. Timing chain stretch can lead to significant problems in operation of the internal combustion engine and can have an adverse effect on one or more of engine performance, fuel economy and emissions.

Chain elongation can cause a deviation from the desired timing of parts operatively connected to the timing chain. Such a deviation may be caused, for example, by the chain skipping one or more sprocket teeth during operation, or exceeding the adjustability of the cam phasers. These deviations may alter the relative timing of the valves and ignition. Intake valve timing influences when the air and/or fuel mixture is drawn into the cylinder. Exhaust valve timing influences power output as power can be lost due to escape of gas via the exhaust valve if the exhaust valve does not open at the appropriate time. Additionally, the amount of unburned hydrocarbon emissions can increase when exhaust valve timing is off since unburned combustion gas may escape via the exhaust valve under such circumstances.

The effects of different base oils on diesel engine timing chain wear were investigated in, "Investigation of Lubrication Effect on a Diesel Engine Timing Chain Wear," Polat, Ozay, M.Sc. Thesis Istanbul Technical University Institute of Science and Technology (January 2008). This thesis concluded that the selection of base oil could influence timing chain wear in diesel engines.

Timing chain wear in light-duty diesel engines may be due to a variety of factors one of which is the contribution of soot to abrasive wear. Li, Shoutian, et al., "Wear in Cummins M-11/EGR Test Engines," Society of Automotive Engineers, Inc. (2001), paper no. 2002-01-1672. This article mentions that in engines with an exhaust gas recirculation (EGR) system, soot caused abrasive wear on liners, crossheads and top ring faces. The article also mentions that the primary focus of soot-induced wear in non-EGR diesel engines has been on roller pin wear in the GM 6.2L engine and crosshead wear in the Cummins M-11 engine.

Chain elongation in gasoline engines is typically the result of roller pin wear. As a result, prior art methods for addressing timing chain stretch typically focus on use and selection of anti-wear agents. As a result of the implementation of TGDi engines, soot is now a by-product of gasoline engine combustion and thus chain elongation may result from soot production in such engines.

Lubricants currently used in gasoline engines to control timing chain stretch typically contain antiwear agents as it is thought that these additives are able reduce the timing chain wear. However, as demonstrated in the examples of the present application, certain typical anti-wear agents actually worsened timing chain stretch. In order to overcome the wear problem that results in timing chain stretch, a solution for reducing the rolling and sliding friction forces that cause roller pin wear is sought.

In some cases, dispersants and dispersant viscosity index improvers have been used to address wear problems. For example, U.S. Pat. No. 7,572,200 B2 discloses a chain drive system that employs a lubricant designed to coat the sliding parts of the system, including the chain and sprocket, with a thin hard carbon coating film having a hydrogen content of 10 atomic percent or less to reduce the amount of friction and wear on the chain drive system.

There remains a need in the art for improvements in lubricating oils and methods of using them to address the problem of timing chain stretch.

SUMMARY AND TERMS

The present disclosure relates to a lubricating oil composition including greater than 50 wt. % of a base oil of lubricating viscosity and an additive composition. The lubricating oil compositions of the present invention may be capable of controlling timing chain stretch in an engine.

The following sentences describe some embodiments of the invention.

1. In a first aspect, the disclosure relates to a lubricating oil composition including:

greater than 50 wt. % of a base oil, based on a total weight of the lubricating oil composition; and an additive composition including:

an amount of one or more zinc dialkyl dithiophosphate(s) sufficient to provide from about 350 ppm to about 2200 ppm zinc to the lubricating oil composition, based on the total weight of the lubricating oil composition, an amount of one or more molybdenum-containing compound(s) sufficient to provide greater than 1 ppm to about 3000 ppm of molybdenum to the lubricating oil composition, based on the total weight of the lubricating oil composition, and an amount of one or more magnesium-containing detergent(s) sufficient to provide less than 2050 ppm magnesium to the lubricating oil composition, based on the total weight of the lubricating oil composition, wherein the lubricating oil composition has a total TBN of less than 7.5 mg KOH/g, as measured by the method of ASTM D-2896, and a weight ratio of ppm of zinc from the one or more zinc dialkyl dithiophosphate(s) to ppm of molybdenum from the one or more molybdenum-containing compound(s), is less than 10.

2. The lubricating oil composition of sentence 1, wherein the lubricating oil composition may have a total sulfated ash content of 2 wt. % or less, based on the total weight of the lubricating oil composition.

3. The lubricating oil composition of any one of sentences 1-2, wherein the weight ratio of ppm of zinc from the one or more zinc dialkyl dithiophosphate(s) to ppm of molybdenum from the one or more molybdenum-containing compound(s), may be less than 6.

4. The lubricating oil composition of any one of sentences 1-3, wherein the one or more zinc dialkyl dithiophosphates may be derived from a primary alkyl alcohol, a secondary alkyl alcohol, or a mixture thereof.

5. The lubricating oil composition of any one of sentences 1-4, wherein the one or more molybdenum-containing compound(s) may include one or more compounds selected from one or more sulfur-free organomolybdenum complexes of organic amides, one or more molybdenum dithiocarbamates, one or more molybdenum diothiophosphates and mixtures thereof.

6. The lubricating oil composition of any one of sentences 1-5, wherein the one or more molybdenum-containing compound(s) may include a sulfur-free organomolybdenum complex of an organic amide.

7. The lubricating oil composition of any one of sentences 1-6, wherein the one or more molybdenum-containing compound(s) may include a molybdenum dithiocarbamate.

8. The lubricating oil composition of any one of sentences 1-7, wherein the one or more magnesium-containing detergent(s) may include an overbased magnesium-containing detergent having a total base number of greater than 225 mg KOH/g, as measured by the method of ASTM D-2896.

9. The lubricating oil composition of any one of sentences 1-8, wherein the one or more magnesium-containing detergent(s) may include a detergent selected from magnesium sulfonate and magnesium phenate.

10. The lubricating oil composition of any one of sentences 1-9, wherein the one or more magnesium-containing detergent(s) may be present in an amount sufficient to provide from 50 ppm to 1000 ppm magnesium to the lubricating oil composition, based on the total weight of the lubricating oil composition.

11. The lubricating oil composition of any one of sentences 1-10, further comprising one or more calcium-containing detergent(s) present in an amount sufficient to provide from 500 ppm to 2000 ppm of calcium to the lubricating oil composition, based on the total weight of the lubricating oil composition.

12. The lubricating oil composition of sentence 11, wherein the one or more calcium-containing detergent(s) may include a detergent selected from a calcium sulfonate detergent and a calcium phenate detergent.

13. The lubricating oil composition of any one of sentences 1-12, further including an amount of one or more boron-containing dispersant(s) sufficient to provide less than 250 ppm of boron to the lubricating oil composition, based on the total weight of the lubricating oil composition.

14. The lubricating oil composition of any one of sentences 1-13, wherein the lubricating oil composition may have a weight ratio of ppm of boron from the one or more boron-containing dispersant(s) to the total TBN of the lubricating oil composition in mg KOH/g of the lubricating oil composition of from 32 to 36, as measured by the method of ASTM D-2896.

15. The lubricating oil composition of any one of sentences 1-14, wherein the lubricating oil composition may further include one or more additives selected from the group consisting of antioxidants, friction modifiers, pour point depressants, and viscosity index improvers.

16. The lubricating oil composition of any one of sentences 1-15, wherein the base oil has a kinematic viscosity at 100° C. of from 3.8 cSt to 12 cSt, as measured according to ASTM-445-19.

17. The lubricating oil composition of any one of sentences 1-16, wherein the base oil has a kinematic viscosity at 100° C. of from about 5 cSt to about 10 cSt, as measured according to ASTM-445-19.

18. The lubricating oil composition of any one of sentences 1-17, wherein the lubricating oil composition may be an engine oil composition.

19. The lubricating oil composition of any one of sentences 1-18, wherein the lubricating oil composition, when used to lubricate an engine, may be capable of achieving a timing chain stretch in an engine of 0.1% or less, or 0.095% or less, or 0.09% or less, as measured by Sequence X Engine Test (ASTM D8279).

20. In a second aspect, the present invention relates to a method for controlling timing chain stretch in an engine comprising a step of lubricating said timing chain with a lubricating oil composition comprising:

greater than 50 wt. % of a base oil, based on a total weight of the lubricating oil composition; and an additive composition comprising an amount of one or more zinc dialkyl dithiophosphate(s) sufficient to provide from about 350 ppm to about 2200 ppm zinc to the lubricating oil composition, based on the total weight of the lubricating oil composition, an amount of one or more molybdenum-containing compound(s) sufficient to provide greater than 1 ppm to about 3000 ppm of molybdenum to the lubricating oil composition, based on the total weight of the lubricating oil composition, an amount of one or more magnesium-containing detergent(s) sufficient to provide less than 2050 ppm magnesium to the lubricating oil composition, based on the total weight of the lubricating oil composition, wherein the lubricating oil composition has a total TBN of less than 7.5 mg KOH/g, as measured by the method of ASTM D-2896, a weight ratio of ppm of zinc from the one or more zinc dialkyl dithiophosphate(s) to ppm of molybdenum from the one or more molybdenum-containing compound(s), is less than 10; and the lubricating oil composition is capable of achieving a timing chain stretch in an engine to 0.1% or less, or 0.095% or less, or 0.09% or less as measured by Sequence X Engine Test (ASTM D8279).

21. The method of sentence 20, wherein the lubricating oil composition may have a total sulfated ash content of 2 wt. % or less, based on the total weight of the lubricating oil composition.

22. The method of any one of sentences 20-21, wherein the weight ratio of ppm of zinc from the one or more zinc dialkyl dithiophosphate(s) to ppm of molybdenum from the one or more molybdenum-containing compound(s), may be less than 6.

23. The method of any one of sentences 20-22, wherein the one or more zinc dialkyl dithiophosphates may be derived from a primary alkyl alcohol, a secondary alkyl alcohol, or a mixture thereof.

24. The method of any one of sentences 20-23, wherein the one or more molybdenum-containing compound(s) may include one or more compounds selected from sulfur-free organomolybdenum complexes of organic amides, one or more molybdenum dithiocarbamates, one or more molybdenum diothiophosphates and mixtures thereof.

25. The method of any one of sentences 20-24, wherein the one or more molybdenum-containing compound(s) may include a sulfur-free organomolybdenum complex of an organic amide.

26. The method of any one of sentences 20-25, wherein the one or more molybdenum-containing compound(s) may include a molybdenum dithiocarbamate.

27. The method of any one of sentences 20-26, wherein the one or more magnesium-containing detergent(s) may include an overbased magnesium-containing detergent having a total base number of greater than 225 mg KOH/g, as measured by the method of ASTM D-2896.

28. The method of any one of sentences 20-27, wherein the one or more magnesium-containing detergent(s) may include a detergent selected from magnesium sulfonate and magnesium phenate.

29. The method of any one of sentences 20-28, wherein the one or more magnesium-containing detergent(s) may be present in an amount sufficient to provide from 50 ppm to 1000 ppm magnesium to the lubricating oil composition, based on the total weight of the lubricating oil composition.

30. The method of any one of sentences 20-29, further comprising one or more calcium-containing detergent(s) in an amount sufficient to provide from 500 ppm to 2000 ppm of calcium to the lubricating oil composition, based on the total weight of the lubricating oil composition.

31. The method of sentence 30, wherein the one or more calcium-containing detergent(s) may include a detergent selected from a calcium sulfonate detergent and a calcium phenate detergent.

32. The method of any one of sentences 20-31, wherein the lubricating oil composition includes an amount of one or more boron-containing dispersant(s) sufficient to provide less than 250 ppm of boron to the lubricating oil composition, based on the total weight of the lubricating oil composition.

33. The method of any one of sentences 20-32, wherein the lubricating oil composition may have a weight ratio of ppm of boron from the one or more boron-containing dispersant(s) to the total TBN of the lubricating oil composition in mg KOH/g of the lubricating oil composition of from 32 to 36, as measured by the method of ASTM D-2896.

34. The method of any one of sentences 20-33, wherein the lubricating oil composition may further include one or more additives selected from the group consisting of antioxidants, friction modifiers, pour point depressants, and viscosity index improvers.

35. The method of any one of sentences 20-34, wherein the base oil may have a kinematic viscosity at 100° C. of from 3.8 cSt to 10 cSt, as measured according to ASTM-445-19.

36. The method of any one of sentences 20-35, wherein the base oil may have a kinematic viscosity at 100° C. of from about 3.8 cSt to about 7.5 cSt, as measured according to ASTM-445-19.

37. The method of any one of sentences 20-36, wherein the lubricating oil composition may be an engine oil composition.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739 or DIN 51639-1.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Lubricants, combinations of components, or individual components of the present description may be suitable for use in for lubrication of the timing chain in various types of internal combustion engines. An internal combustion engine may be a gasoline fueled engine, a mixed gasoline/biofuel fueled engine, an alcohol fueled engine, or a mixed gasoline/alcohol fueled engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine engines, aviation piston engines, and motorcycle, automobile, locomotive, and truck engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubrited coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

The lubricant composition of the present disclosure may be suitable for any engine irrespective of the sulfur, phosphorus, or sulfated ash (ASTM D-874) content. The sulfur content of the lubricating oil may be about 1 wt. % or less, or about 0.8 wt. % or less, or about 0.5 wt. % or less, or about 0.3 wt. % or less. In one embodiment the sulfur content may be in the range of about 0.001 wt. % to about 0.5 wt. %, or about 0.01 wt. % to about 0.3 wt. %. The phosphorus content may be about 0.5 wt. % or less, or about 0.1 wt. % or less, or about 0.094 wt. % or less, or about 0.001 wt. % to about 0.5 wt. %, or about 0.01 wt. % to about 0.1 wt. %.

In one embodiment the phosphorus content of the lubricant compositions of the present disclosure may be about 100 ppm to about 1000 ppm, or about 325 ppm to about 950 ppm. The total sulfated ash content may be about 2 wt. % or less, or about 1.5 wt. % or less, or about 1.2 wt. % or less. In one embodiment the sulfated ash content may be about 0.05 wt. % to about 1.5 wt. %, or about 0.1 wt. % or about 0.2 wt. % to about 1.15 wt. %. In another embodiment, the sulfur content may be about 0.4 wt. % or less, the phosphorus content may be about 0.08 wt. % or less, and the sulfated ash is about 1.2 wt. % or less. In yet another embodiment the sulfur content may be about 0.3 wt. % or less, the phosphorus content is about 0.05 wt. % or less, and the sulfated ash may be about 1.15 wt. % or less.

In one embodiment the timing chain lubricating composition is also suitable for use as an engine oil, for example, for lubrication of the crankcase of an engine. In other embodiments, the lubricating composition may have one or more of: (i) a sulfur content of about 0.5 wt. % or less, (ii) a phosphorus content of about 0.1 wt. % or less, and (iii) a sulfated ash content of about 1.5 wt. % or less.

In some embodiments, the lubricating composition is not suitable for a 2-stroke or a 4-stroke marine diesel internal combustion engine for one or more reasons, including but not limited to, the high sulfur content of fuel used in powering a marine engine and the high sulfur content of fuel used in power a marine engine and the high TBN required for marine-suitable engine oil (e.g. above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur).

Low speed diesel typically refers to marine engines, medium speed diesel typically refers to locomotives, and high speed diesel typically refers to highway vehicles. The lubricating oil composition may be suitable for only one of these types or all.

Further, lubricants of the present description may be suitable to meet one or more industry specification requirements such as ILSAC GF-3, GF-4, GF-5, GF-6, PC-11, CF, CF-4, CH-4, CK-4, FA-4, CJ-4, CI-4 Plus, CI-4, API SG, SJ, SL, SM, SN, ACEA A1/B1, A2/B2, A3/B3, A3/B4, A5/B5, C1, C2, C3, C4, C5, E4/E6/E7/E9, Euro 5/6, JASO DL-1, Low SAPS, Mid SAPS, or original equipment manufacturer specifications such as Dexos™ 1, Dexos™ 2, MB-Approval 229.1, 229.3, 229.5, 229.51/229.31, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Longlife-17 FE+, Porsche A40, C30, Peugeot Citroen Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS-M2C913-C, WSS-M2C913-D, WSS-M2C948-B, WSS-M2C948-A, GM 6094-M, Chrysler MS-6395, Fiat 9.55535 G1, G2, M2, N1, N2, Z2, S1, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007, STJLR.51.5122 or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Tractor fluids, and for example Super Tractor Universal Oils (STUOs) or Universal Tractor Transmission Oils (UTTOs), may combine the performance of engine oils with transmissions, differentials, final-drive planetary gears, wet-brakes, and hydraulic performance. While many of the additives used to formulate a UTTO or a STUO fluid are similar in functionality, they may have deleterious effect if not incorporated properly. For example, some anti-wear and extreme pressure additives used in engine oils can be extremely corrosive to the copper components in hydraulic pumps. Detergents and dispersants used for gasoline or diesel engine performance may be detrimental to wet brake performance. Friction modifiers specific to quiet wet brake noise, may lack the thermal stability required for engine oil performance. Each of these fluids, whether functional, tractor, or lubricating, are designed to meet specific and stringent manufacturer requirements.

The present disclosure provides novel lubricating oil blends formulated for use as automotive crankcase lubricants. The present disclosure provides novel lubricating oil blends formulated for use as 2T and/or 4T motorcycle crankcase lubricants. Embodiments of the present disclosure may provide lubricating oils suitable for crankcase applications and having improvements in the following characteristics: air entrainment, alcohol fuel compatibility, antioxidancy, antiwear performance, biofuel compatibility, foam reducing properties, friction reduction, fuel economy, pre-ignition prevention, rust inhibition, sludge and/or soot dispersability, piston cleanliness, deposit formation, and water tolerance.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Figure 1:
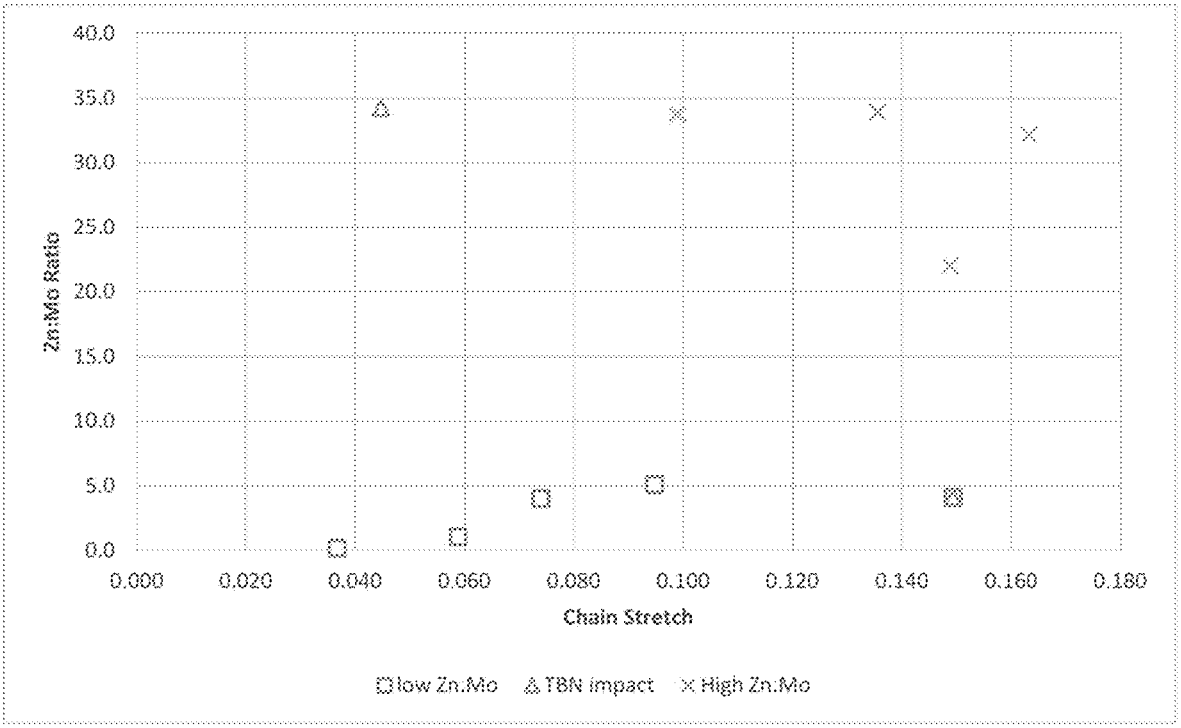
FIG. 1 is a graph showing the effect of the weight ratio of the ppm of zinc from the one or more zinc dialkyl dithiophosphate(s) to the ppm of molybdenum from the one or more molybdenum-containing compound(s) on chain stretch for the examples of Table 3, except for comparative example CE-4.
Figure 2:
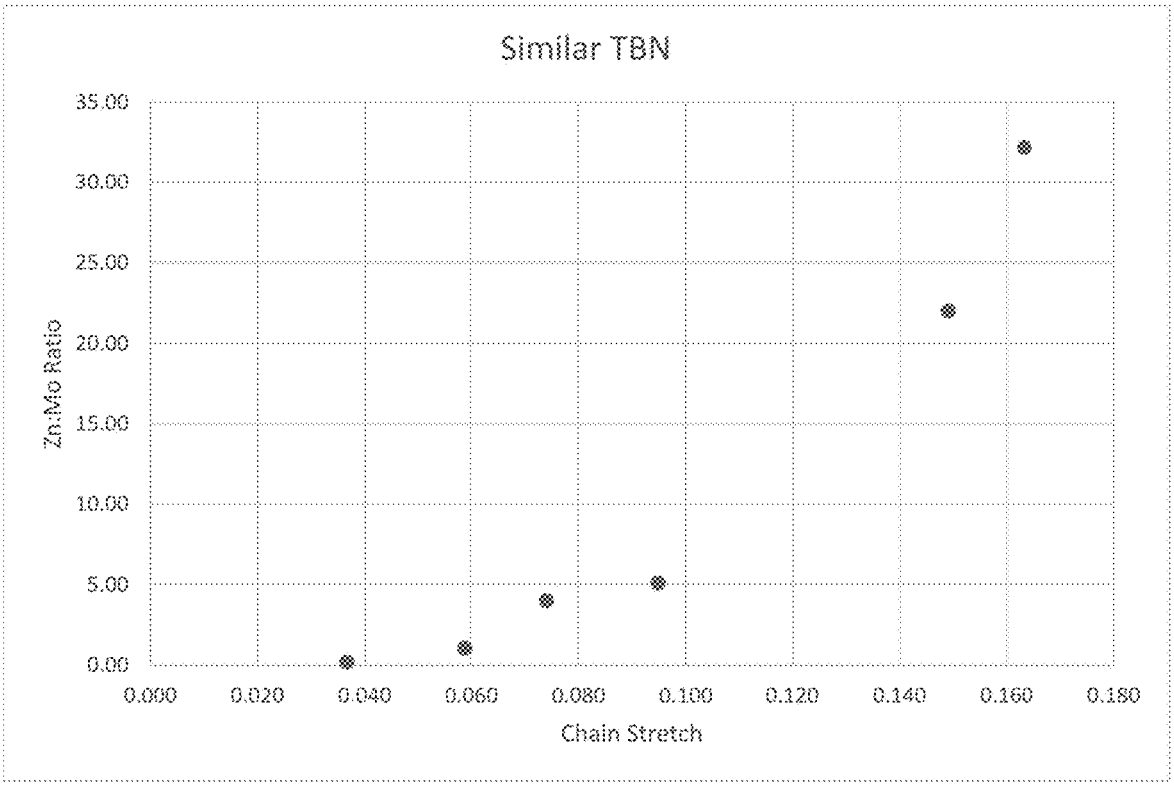
FIG. 2 is a graph showing the effect of the weight ratio of ppm of zinc from the one or more zinc dialkyl dithiophosphate(s) to the ppm of molybdenum from the one or more molybdenum-containing compound(s) on chain stretch for compositions with similar TBNs. Specifically, the results for comparative examples CE-2, CE-5 and CE-6 and inventive examples IE-1, and IE-3 are shown.

Various embodiments of the disclosure provide a lubricating oil composition and methods for controlling timing chain stretch in an engine.

In one aspect, the disclosure relates to lubricating oil compositions including:

greater than 50 wt. % of a base oil, based on a total weight of the lubricating oil composition; and an additive composition including:

an amount of one or more zinc dialkyl dithiophosphate(s) sufficient to provide from about 350 ppm to about 2200 ppm zinc to the lubricating oil composition, based on the total weight of the lubricating oil composition, an amount of one or more molybdenum-containing compound(s) sufficient to provide greater than 1 ppm to about 3000 ppm of molybdenum to the lubricating oil composition, based on the total weight of the lubricating oil composition, and an amount of one or more magnesium-containing detergent(s) sufficient to provide less than 2050 ppm magnesium to the lubricating oil composition, based on the total weight of the lubricating oil composition, wherein the lubricating oil composition has a total TBN of less than 7.5 mg KOH/g, as measured by the method of ASTM D-2896, and a weight ratio of ppm of zinc from the one or more zinc dialkyl dithiophosphate(s) to ppm of molybdenum from the one or more molybdenum-containing compound(s), is less than 10.

In a second aspect, the present invention relates to methods for controlling timing chain stretch in an engine comprising a step of lubricating said timing chain with a lubricating oil composition comprising:

greater than 50 wt. % of a base oil, based on a total weight of the lubricating oil composition; and an additive composition comprising:

an amount of one or more zinc dialkyl dithiophosphate(s) sufficient to provide from about 350 ppm to about 2200 ppm zinc to the lubricating oil composition, based on the total weight of the lubricating oil composition, an amount of one or more molybdenum-containing compound(s) sufficient to provide greater than 1 ppm to about 3000 ppm of molybdenum to the lubricating oil composition, based on the total weight of the lubricating oil composition, an amount of one or more magnesium-containing detergent(s) sufficient to provide less than 2050 ppm magnesium to the lubricating oil composition, based on the total weight of the lubricating oil composition, wherein the lubricating oil composition has a total TBN of less than 7.5 mg KOH/g, as measured by the method of ASTM D-2896, a weight ratio of ppm of zinc from the one or more zinc dialkyl dithiophosphate(s) to ppm of molybdenum from the one or more molybdenum-containing compound(s), is less than 10; and the lubricating oil composition is capable of achieving a timing chain stretch in an engine of 0.1% or less, or 0.095% or less, 0.09% or less, as measured by the Sequence X Ford Chain Wear Test over 216 hours.

In some embodiments, the lubricating oil composition has a total TBN of less than 7.25 mg KOH/g, or less than 7 mg KOH/g, as measured by the method of ASTM D-2896.

Base Oil

The base oil used in the lubricating oil compositions herein may be selected from any of the base oils in Groups I-V as specified in the American Petroleum Institute (API) Base Oil Interchangeability Guidelines. The five base oil groups are as follows:

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt. % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt. %, greater than about 60 wt. %, greater than about 70 wt. %, greater than about 80 wt. %, greater than about 85 wt. %, or greater than about 90 wt. %.

In some embodiments, the base oil may have a kinematic viscosity at 100° C. of from about 3.8 cSt to 10 cSt, or from about 3.8 to about 7.5 cSt, as measured according to ASTM-445-19. In some embodiments, the base oil may have a SAE viscosity grade of 5W-20 or 5W-30, or an SAE viscosity grade of OW-20.

Zinc Dialkyl Dithiophosphate(s)

The additive composition of the disclosure contains an amount of one or more zinc dialkyl dithiophosphate(s) sufficient to provide from about 350 ppm to about 2200 ppm zinc to the lubricating oil composition, based on the total weight of the lubricating oil composition.

The ZDDP compounds can comprise ZDDPs derived from primary alkyl alcohols, secondary alkyl alcohols, or a combination of primary and secondary alkyl alcohols.

Zinc dialkyl dithiophosphates (ZDDP) are oil soluble salts of dialkyl dithiophosphoric acids and may be represented by the following formula:

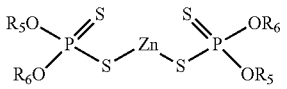

wherein $R_5$ and $R_6$ may be the same or different alkyl and/or cycloalkyl groups containing from 1 to 18 carbon atoms, or 2 to 12 carbon atoms, or 2 to 8 carbon atoms. Thus, the alkyl and/or cycloalkyl groups may be, for example, ethyl, n-propyl, i-propyl, n-butyl, i-butyl, sec-butyl, amyl, n-hexyl, i-hexyl, n-octyl, decyl, dodecyl, octadecyl, 2-ethylhexyl, cyclohexyl, methylcyclopentyl, propenyl, or butenyl.

The average number of total number of carbon atoms per mole of phosphorus for a ZDDP compound may be calculated by dividing by two the sum of the carbon atoms in the four alkyl groups $R_5$ and $R_6$ provided to the ZDDP compound by alcohol(s) used to make the ZDDP compound. For example, for a single ZDDP compound, if $R_5$ is a $C_3$-alkyl group and $R_6$ is a $C_6$ alkyl group, the total number of carbon atoms is 3+3+6+6=18. Dividing this by two moles of phosphorus per mole of ZDDP gives an average total number of carbon atoms per mole of phosphorus of 9.

The average total number of carbon atoms per mole of phosphorus (ATCP) for compositions containing one or more ZDDP compounds may be calculated from the alcohol(s) used to make the ZDDP compounds according to the following formula:

ATCP=2*[(mol % of *alc*1*# of *C* atoms in *alc*1)+ (mol % of *alc*2*# of *C* atoms in *alc*2)+(mol % of *alc*3*# of *C* atoms in *alc*3)+ . . . etc.]

wherein alc1, alc2 and alc3 each represent a different alcohol used to make the ZDDP compound(s) and the mol % is the molar percentage of each of the alcohols that was present in the reaction mixture used to make the ZDDP compound(s). The "etc." indicates that if more than three alcohols are used to make the ZDDP compounds(s), the formula can be expanded to include each of the alcohols present in the reaction mixture.

The average total number of carbon atoms in $R_5$ and $R_6$ in the ZDDP is greater than 4 carbon atoms per mole of phosphorus, and in one embodiment in the range from greater than 4 to about 20 carbon atoms, and in one embodiment in the range from greater than 4 to about 16 carbon atoms, and in one embodiment in the range from about 6 to about 10 carbon atoms per mole of phosphorus.

The zinc dialkyl dithiophosphate(s) metal salts may be prepared in accordance with known techniques by first forming a dialkyl dithiophosphoric acid (DDPA), usually by reaction of one or more alcohols and then neutralizing the formed DDPA with a metal compound. To make the metal salt, any basic or neutral metal compound could be used but the oxides, hydroxides, and carbonates are most generally employed. The zinc dialkyl dithiophosphates may be made by a process such as the process generally described in U.S. Pat. No. 7,368,596.

In some embodiments, the at least one zinc dialkyl dithiophosphate salt may be present in the lubricating oil in an amount sufficient to provide from about 350 ppm to about 2200 ppm zinc, or from about 350 ppm to about 2180 ppm zinc, or from about 375 ppm to about 1500 ppm zinc, or from about 375 ppm to about 1000 ppm zinc, based on the total weight of the lubricating oil composition.

In some embodiments, the at least one zinc dialkyl dithiophosphate salt may be present in the lubricating oil in an amount sufficient to provide from about 200 to about 1000 ppm phosphorus, or from about 300 to about 900 ppm phosphorus, or from about 400 to about 800 ppm phosphorus, or from about 550 to about 700 ppm phosphorus, based on the total weight of the lubricating oil composition.

In some embodiments, the additive package may comprise two or more zinc dialkyl dithiophosphate(s). The two or more zinc dialkyl dithiophosphate may deliver from about 350 ppm to about 2200 ppm of zinc to the lubricating oil composition. In embodiments comprising two or more zinc dialkyl dithiophosphates, the first zinc dialkyl dithiophosphate may be derived from a primary alkyl alcohol, or a secondary alkyl alcohol and the second zinc dialkyl dithiophosphate may be derived from a primary alkyl alcohol or a secondary alkyl alcohol, wherein the first and second zinc dialkyl dithiophosphate are derived from the same or different alcohol.

The zinc dialkyl dithiophosphate compound may be present in ranges including about 0.01 wt. % to about 15 wt. %, or about 0.05 wt. % to about 10 wt. %, or about 0.1 wt. % to about 5 wt. %, or about 0.1 wt. % to about 3.5 wt. %, based on the total weight of the lubricating composition.

In some embodiments, the lubricating oil composition has a weight ratio of ppm of zinc from the one or more zinc dialkyl dithiophosphate(s) to ppm of molybdenum from the one or more molybdenum-containing compound(s) of less than 10, or less than 8, or less than 6.

Molybdenum-Containing Component

The lubricating oil compositions of the present disclosure contains an amount of one or more molybdenum-containing compounds sufficient to provide greater than 1 ppm to about 3000 ppm of molybdenum to the lubricating oil composition, based on the total weight of the lubricating oil composition. The one or more molybdenum-containing compounds may be an oil-soluble molybdenum compound and may have the functional performance of an antiwear agent, an antioxidant, a friction modifier, or mixtures thereof.

Suitable examples of oil-soluble molybdenum compounds may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In some embodiments, the oil-soluble molybdenum compound may be a sulfur-free organomolybdenum complexes of organic amides, a molybdenum dithiocarbamate, a molybdenum diothiophosphate and mixtures thereof. In some embodiments, the one or more molybdenum-containing compound(s) comprise a sulfur-free organomolybdenum complex of an organic amide. In some embodiments, the one or more molybdenum-containing compound(s) comprises a molybdenum dithiocarbamate.

Suitable examples of molybdenum compounds which may be used include commercial materials sold under the trade names such as Molyvan 822™, Molyvan™ A, Molyvan 2000™, Molyvan™ 3000, Molyvan™ 1055, and Molyvan 855™ from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685.

The oil-soluble molybdenum compound may be present in an amount sufficient to provide about 1 ppm to about 3000 ppm, or from about 50 ppm to about 2500 ppm, or from about 90 ppm to about 2200, or from about about 90 ppm to about 2100 ppm, about 95 ppm to about 300 ppm of molybdenum to the lubricating oil composition, based on the total weight of the lubricating oil composition. In another embodiment, the molybdenum compound may be present in an amount sufficient to provide about 100 ppm to about 1000 ppm, or about 150 ppm to about 600 ppm of molybdenum to the lubricating oil composition, based on the total weight of the lubricating oil composition.

Magnesium Detergent

The lubricating oil composition comprises one or more magnesium-containing detergents. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as magnesium. In some embodiments, the detergent is free of barium. A suitable detergent may include alkali or alkaline earth metal salts of petroleum sulfonic acids and long chain mono- or di-alkylarylsulfonic acids with the aryl group being benzyl, tolyl, and xylyl. Examples of suitable additional detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergents are well known in the art and may be alkali or alkaline earth metal overbased detergents. Such detergents may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent has a TBN of greater 225 mg KOH/gram, or as further examples, a TBN of about 250 mg KOH/gram or greater, or a TBN of about 300 mg KOH/gram or greater, or a TBN of about 350 mg KOH/gram or greater, or a TBN of about 375 mg KOH/gram or greater, or a TBN of about 400 mg KOH/gram or greater.

Examples of suitable overbased detergents include, but are not limited to, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, or from 2:1, or from 4:1, or from 5:1, or from 7:1, or from 10:1.

In some embodiments, a detergent is effective at reducing or preventing rust in an engine.

The total detergent may be present at up to 10 wt. %, or about up to 8 wt. %, or up to about 4 wt. %, or greater than about 4 wt. % to about 8 wt. % based on a total weight of the lubricating oil composition.

The total detergent may be present in an amount to provide from about 900 to about 3500 ppm metal to the lubricating oil composition, based on the total weight of the lubricating oil composition. In other embodiments, the total detergent may provide from about 1000 to about 2500 ppm of metal, or about 1150 to about 2200 ppm of metal, or about 1200 to about 2400 ppm of metal to the lubricating oil composition, based on the total weight of the lubricating oil composition.

The amount of the one or more magnesium-containing detergent(s) may be sufficient to provide less than about 2050 ppmw of magnesium, or from 50 ppmw to 1000 ppm of magnesium, or from 100 ppm to less than 600 ppmw of magnesium, or from 100 ppm to less than 450 ppm of magnesium to the lubricating oil composition, based on the total weight of the lubricating oil composition.

The one or more magnesium-containing detergents may be overbased magnesium-containing detergents having a total base number of greater than 225 mg KOH/gram, or as further examples, a TBN of about 250 mg KOH/gram or greater, or a TBN of about 300 mg KOH/gram or greater, or a TBN of about 350 mg KOH/gram or greater, or a TBN of about 375 mg KOH/gram or greater, or a TBN of about 400 mg KOH/gram or greater, measured by the method of ASTM D-2896 and the one or more overbased magnesium-containing detergents may be selected from an overbased magnesium sulfonate detergent, an overbased magnesium phenate detergent, an overbased magnesium salicylate detergent and mixtures thereof. Alternatively, the magnesium-containing detergents may include one or more of the magnesium-containing detergents described above, including low-based/neutral magnesium-containing detergents.

In some embodiments, the lubricating oil composition has a ratio of total millimoles metal (M) to TBN of the lubricating oil composition ranging from greater than 4.5 to about 10.0. In some embodiments the ratio of total millimoles metal (M) to TBN of the lubricating oil composition ranges from greater than 8 to less than 10.0 or from 8 to 9.5 or from 8.1 to 9.0.

The lubricating oil composition may also include one or more optional components selected from the various additives set forth below.

Boron-Containing Compounds

The lubricating oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt. %, about 0.01 wt. % to about 7 wt. %, about 0.05 wt. % to about 5 wt. %, or about 0.1 wt. % to about 3 wt. % of the lubricating oil composition.

Optional Additional Detergents

The lubricating oil composition may optionally further comprise one or more neutral, low based, or overbased detergents, and mixtures thereof. In some embodiments, the lubricating oil composition further comprises one or more calcium containing detergent(s) present in an amount sufficient to provide from 500 ppm to 2000 ppm of calcium, or from 1000 ppm to 1800 ppm of calcium, based on the total weight of the lubricating oil composition.

Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1.

In some embodiments, a detergent is effective at reducing or preventing rust in an engine.

The detergent may be present at about 0 wt. % to about 10 wt. %, or about 0.1 wt. % to about 8 wt. %, or about 1 wt. % to about 4 wt. %, or greater than about 4 wt. % to about 8 wt. %.

In some embodiments, the lubricating oil composition additionally includes one or more calcium-containing detergent(s), wherein the calcium containing detergent comprises an overbased calcium-containing detergent, a low-based/neutral detergent, or mixtures thereof. Preferably, the calcium containing detergent is selected from a calcium sulfonate detergent and a calcium phenate detergent.

Dispersants

The lubricating oil composition may optionally further comprise one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or 4,234,435. The polyolefin may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

Suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride.

In one embodiment, the dispersant may be derived from olefin maleic anhydride copolymer. As an example, the dispersant may be described as a poly-PIBSA.

In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

The hydrocarbyl moiety of the hydrocarbyl-dicarboxylic acid or anhydride of Component A) may alternatively be derived from ethylene-alpha olefin copolymers. These copolymers contain a plurality of ethylene units and a plurality of one or more $C_3$-$C_{10}$ alpha-olefin units. The $C_3$-$C_{10}$ alpha-olefin units may include propylene units.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with:

Inorganic phosphorous acids or anhydrates (e.g., U.S. Pat. Nos. 3,403,102 and 4,648,980);

Organic phosphorous compounds (e.g., U.S. Pat. No. 3,502,677);

Phosphorous pentasulfides;

Boron compounds as already noted above (e.g., U.S. Pat. Nos. 3,178,663 and 4,652,387);

Carboxylic acid, polycarboxylic acids, anhydrides and/or acid halides (e.g., U.S. Pat. Nos. 3,708,522 and 4,948,386);

Epoxides polyepoxiates or thioexpoxides (e.g., U.S. Pat. Nos. 3,859,318 and 5,026,495);

Aldehyde or ketone (e.g., U.S. Pat. No. 3,458,530);

Carbon disulfide (e.g., U.S. Pat. No. 3,256,185);

Glycidol (e.g., U.S. Pat. No. 4,617,137);

Urea, thourea or guanidine (e.g., U.S. Pat. Nos. 3,312,619; 3,865,813; and British Patent GB 1,065,595);

Organic sulfonic acid (e.g., U.S. Pat. No. 3,189,544 and British Patent GB 2,140,811);

Alkenyl cyanide (e.g., U.S. Pat. Nos. 3,278,550 and 3,366,569);

Diketene (e.g., U.S. Pat. No. 3,546,243);

A diisocyanate (e.g., U.S. Pat. No. 3,573,205);

Alkane sultone (e.g., U.S. Pat. No. 3,749,695);

1,3-Dicarbonyl Compound (e.g., U.S. Pat. No. 4,579,675);

Sulfate of alkoxylated alcohol or phenol (e.g., U.S. Pat. No. 3,954,639);

Cyclic lactone (e.g., U.S. Pat. Nos. 4,617,138; 4,645,515; 4,668,246; 4,963,275; and 4,971,711);

Cyclic carbonate or thiocarbonate linear monocarbonate or polycarbonate, or chloroformate (e.g., U.S. Pat. Nos. 4,612,132; 4,647,390; 4,648,886; 4,670,170);

Nitrogen-containing carboxylic acid (e.g., U.S. Pat. No. 4,971,598 and British Patent GB 2,140,811);

Hydroxy-protected chlorodicarbonyloxy compound (e.g., U.S. Pat. No. 4,614,522);

Lactam, thiolactam, thiolactone or ditholactone (e.g., U.S. Pat. Nos. 4,614,603 and 4,666,460);

Cyclic carbonate or thiocarbonate, linear monocarbonate or plycarbonate, or chloroformate (e.g., U.S. Pat. Nos. 4,612,132; 4,647,390; 4,646,860; and 4,670,170);

Nitrogen-containing carboxylic acid (e.g., U.S. Pat. No. 4,971,598 and British Patent GB 2,440,811);

Hydroxy-protected chlorodicarbonyloxy compound (e.g., U.S. Pat. No. 4,614,522);

Lactam, thiolactam, thiolactone or dithiolactone (e.g., U.S. Pat. Nos. 4,614,603, and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189);

Oxidizing agent (e.g., U.S. Pat. No. 4,379,064);
Combination of phosphorus pentasulfide and a polyalkylene polyamine (e.g., U.S. Pat. No. 3,185,647);
Combination of carboxylic acid or an aldehyde or ketone and sulfur or sulfur chloride (e.g., U.S. Pat. Nos. 3,390,086; 3,470,098);
Combination of a hydrazine and carbon disulfide (e.g. U.S. Pat. No. 3,519,564);
Combination of an aldehyde and a phenol (e.g., U.S. Pat. Nos. 3,649,229; 5,030,249; 5,039,307);
Combination of an aldehyde and an O-diester of dithiophosphoric acid (e.g., U.S. Pat. No. 3,865,740);
Combination of a hydroxyaliphatic carboxylic acid and a boric acid (e.g., U.S. Pat. No. 4,554,086);
Combination of a hydroxyaliphatic carboxylic acid, then formaldehyde and a phenol (e.g., U.S. Pat. No. 4,636,322);
Combination of a hydroxyaliphatic carboxylic acid and then an aliphatic dicarboxylic acid (e.g., U.S. Pat. No. 4,663,064);
Combination of formaldehyde and a phenol and then glycolic acid (e.g., U.S. Pat. No. 4,699,724);
Combination of a hydroxyaliphatic carboxylic acid or oxalic acid and then a diisocyanate (e.g. U.S. Pat. No. 4,713,191);
Combination of inorganic acid or anhydride of phosphorus or a partial or total sulfur analog thereof and a boron compound (e.g., U.S. Pat. No. 4,857,214);
Combination of an organic diacid then an unsaturated fatty acid and then a nitrosoaromatic amine optionally followed by a boron compound and then a glycolating agent (e.g., U.S. Pat. No. 4,973,412);
Combination of an aldehyde and a triazole (e.g., U.S. Pat. No. 4,963,278);
Combination of an aldehyde and a triazole then a boron compound (e.g., U.S. Pat. No. 4,981,492);
Combination of cyclic lactone and a boron compound (e.g., U.S. Pat. Nos. 4,963,275 and 4,971,711).
The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

The dispersant, if present, can be used in an amount sufficient to provide up to about 20 wt. %, based upon the final weight of the lubricating oil composition. Another amount of the dispersant that can be used may be about 0.1 wt. % to about 15 wt. %, or about 0.1 wt. % to about 10 wt. %, or about 3 wt. % to about 10 wt. %, or about 1 wt. % to about 6 wt. %, or about 7 wt. % to about 12 wt. %, based upon the final weight of the lubricating oil composition. In some embodiments, the lubricating oil composition utilizes a mixed dispersant system. A single type or a mixture of two or more types of dispersants in any desired ratio may be used.

In some embodiments, the lubricating oil composition optionally includes one or more boron containing-dispersant(s) sufficient to provide less than 250 ppm of boron to the lubricating oil composition, based on the total weight of the lubricating oil composition. In some embodiments, the lubricating oil composition has a weight ratio of ppm of boron from the one or boron-containing dispersant(s) to the total TBN of the lubricating oil composition in mg KOH/g of the lubricating oil composition of from 32 to 36, as measured by the method of ASTM D-2896.

Antioxidants

The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing is (0 to 2): (0 to 2): (0 to 1).

The one or more antioxidant(s) may be present in ranges about 0 wt. % to about 20 wt. %, or about 0.1 wt. % to about 10 wt. %, or about 1 wt. % to about 5 wt. %, of the lubricating oil composition.

Antiwear Agents

The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt. % to about 15 wt. %, or about 0.01 wt. % to about 10 wt. %, or about 0.05 wt. % to about 5 wt. %, or about 0.1 wt. % to about 3 wt. % of the lubricating oil composition.

Friction Modifiers

The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt. % to about 10 wt. %, or about 0.01 wt. % to about 8 wt. %, or about 0.1 wt. % to about 4 wt. %.

Additional Molybdenum-Containing Component

The lubricating oil compositions herein also may optionally contain one or more additional molybdenum-containing compounds. The additional oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organomolybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum to the lubricating oil composition, based on the total weight of the lubricating oil composition.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl-(or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl-(or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

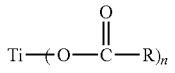

wherein n is an integer selected from 2, 3 and 4, and R is a hydrocarbyl group containing from about 5 to about 24 carbon atoms, or by the formula:

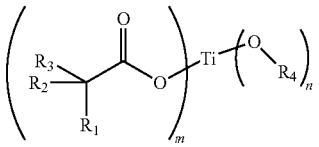

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

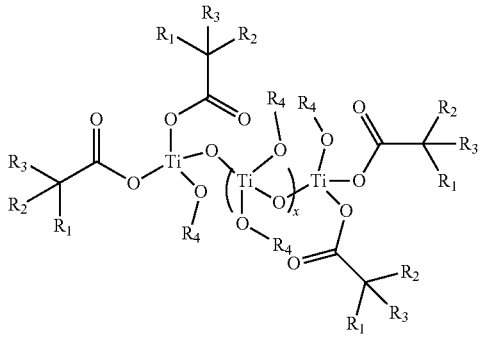

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers

The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt. % to about 20 wt. %, about 0.1 wt. % to about 15 wt. %, about 0.1 wt. % to about 12 wt. %, or about 0.5 wt. % to about 10 wt. %, of the lubricating oil composition.

Other Optional Additives

Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt. % to about 1 wt. %, about 0.01 wt. % to about 0.5 wt. %, or about 0.02 wt. % to about 0.04 wt. % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt. % to about 5 wt. %, about 0.01 wt. % to about 3 wt. %, about 0.1 wt. % to about 2 wt. %, based upon the final weight of the lubricating oil composition.

In general terms, a suitable crankcase lubricant may include additive components in the ranges listed in the following table.

TABLE 2

| Component | Wt. % (Suitable Embodiments) | Wt. % (Suitable Embodiments) |
|---|---|---|
| Dispersant(s) | 0.1-20.0 | 1.0-10.0 |
| Antioxidant(s) | 0.1-5.0 | 0.01-3.0 |
| Detergent(s) | 0.1-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) (on a liquid/dilute basis) | 0.0-25.0 | 0.1-15.0 |
| Dispersant viscosity index improver(s) | 0.0-10.0 | 0.0-5.0 |
| Friction modifier(s) | 0.01-5.0 | 0.05-2.0 |
| Base oil(s) | Balance | Balance |
| Total | 100 | 100 |

The percentages of each component above represent the weight percent of each component, based upon the weight of the final lubricating oil composition. The remainder of the lubricating oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

EXAMPLES

The following examples are illustrative, but not limiting, of the compositions and methods of the present disclosure.

A series of tests were carried out to determine the impact of the one or more zinc dialkyl dithiophosphate, the one or more molybdenum-containing compounds, and the one or more magnesium-containing detergents on timing chain stretch. The operation of the timing chain was simulated by the Ford Chain Wear Test described in greater detail below.

Each of the lubricating oil compositions contained a major amount of a base oil and a conventional dispersant inhibitor (DI) package, wherein the base DI package provided about 2 to about 10 percent by weight of the total weight of the lubricating oil composition. The base DI package contained conventional amounts of dispersant(s), antiwear additive(s), antioxidant(s), friction modifier(s), pour point depressant(s), and viscosity index improver as set forth in Table 2. The components that were varied are specified in the tables and discussion of the Examples provided below. All the values listed are stated as weight percent of the component based on the total weight of the lubricating oil composition (i.e., the amount of component reflects active ingredient plus diluent oil, if any), unless specified otherwise.

Ford Chain Wear Test

The lubricating oils of Comparative Examples 1-8 and Inventive Examples 1-3 as set forth below were tested in the using the ILSAC Sequence X test, according to ASTM D8279.

The Sequence X test, according to ASTM D8279 measures the timing-chain length after engine break in and at the end of a 216 hour test. The test is conducted for 54 cycles, each 4 hour cycle consisting of operation at two stages with differing operating conditions for a total test length of 216 hours. While the operating conditions are varied within each cycle, overall they can be characterized as a mixture of low and moderate-temperature, light and medium duty operating conditions.

The test engine employed is a Ford 2.0 L, spark-ignition, four-stroke, four-cylinder, gasoline, turbocharged, direct-injection (GTDI) engine with dual overhead camshafts driven by a timing chain, four valves per cylinder, and electronic fuel injection.

SASH

Sulfated ash (SASH) was calculated based on the total of the metallic elements that contribute to SASH in the lubricant composition according to the following factors that were multiplied by the amount of each metallic element in the lubricant composition.

| Element | Factor | Element | Factor |
|---|---|---|---|
| Barium | 1.70 | Magnesium | 4.95 |
| Boron | 3.22 | Manganese | 1.291 |
| Calcium | 3.40 | Molybdenum | 1.50 |
| Copper | 1.252 | Potassium | 2.33 |
| Lead | 1.464 | Sodium | 3.09 |
| Lithium | 7.92 | Zinc | 1.50 |

To determine the amount of sulfated ash present in each of the lubricating oil compositions, the ppmw content of each of the metallic elements present in a lubricating oil composition which is considered to contribute to sulfated ash is multiplied by the corresponding factor. The product for each metallic element is summed and divided by 10000.

For example, Comparative Example 1 (CE-1) comprised of 217 ppmw of boron, 1320 ppmw of calcium, 341 ppmw of magnesium, 24 ppmw of molybdenum, and 814 ppmw of zinc. Therefore, to determine the amount of SASH present in CE-1 the following calculation was carried out:

$$217 \text{ ppmw boron} \times 3.22 = 699$$

$$1320 \text{ ppmw calcium} \times 3.4 = 4488$$

$$341 \text{ ppmw magnesium} \times 4.95 = 1688$$

$$24 \text{ ppmw molybdenum} \times 1.5 = 36$$

$$814 \text{ ppmw zinc} \times 1.5 = 1221$$

$$\frac{699 + 4488 + 1688 + 36 + 1221}{10000} = 0.81 \text{ wt. \% } SASH$$

All sulfated ash (SASH) contents given in the present application were calculated using this calculation method.

The timing chain stretch results are presented in Table 3 below.

TABLE 3

| | CE-1 | CE-2 | IE-1 | IE-2 | IE-3 | CE-3 | CE-4 | CE-5 | CE-6 | CE-7 | CE-8 |
|---|---|---|---|---|---|---|---|---|---|---|---|
| Kinematic viscosity 100° C., cSt | 8.480 | 8.564 | 8.521 | 8.536 | 8.760 | 8.395 | 8.549 | 8.589 | 8.707 | 8.603 | 8.444 |
| Ca ppm from total calcium-containing detergent(s) | 1320 | 1320 | 1320 | 1320 | 1320 | 1320 | 1320 | 1320 | 1320 | 0 | 0 |

TABLE 3-continued

| | CE-1 | CE-2 | IE-1 | IE-2 | IE-3 | CE-3 | CE-4 | CE-5 | CE-6 | CE-7 | CE-8 |
|---|---|---|---|---|---|---|---|---|---|---|---|
| Mg ppm from total magnesium-containing detergent(s) | 341 | 346 | 360 | 353 | 349 | 678 | 356 | 352 | 358 | 1526 | 600 |
| B ppm from total boron containing-dispersant(s) | 217 | 228 | 233 | 233 | 237 | 223 | 237 | 236 | 235 | 239 | 237 |
| Mo ppm from total molybdenum-containing compound(s) | 24 | 26 | 167 | 99 | 2044 | 24 | 1 | 98 | 2061 | 24 | 100 |
| Zn from total ZDDP compound(s) | 814 | 837 | 850 | 396 | 2176 | 809 | 392 | 2157 | 394 | 822 | 412 |
| B ppm from total boron containing dispersant(s) | 31.4 | 34.5 | 35.3 | 33.8 | 32.0 | 26.5 | 33.9 | 33.7 | 30.5 | 25.2 | 46.5 |
| TBN from total lubricating oil composition | | | | | | | | | | | |
| Zn ppm from total ZDDP compound(s) | 33.9 | 32.2 | 5.1 | 4.0 | 1.1 | 33.7 | 392.0 | 22.0 | 0.2 | 34.3 | 4.1 |
| Mo ppm from total molybdenum - containing compound(s) | | | | | | | | | | | |
| TBN of total lubricating oil composition (ASTM - D2896) | 6.9 | 6.6 | 6.6 | 6.9 | 7.4 | 8.4 | 7 | 7 | 7.7 | 9.5 | 5.1 |
| Chain Stretch over 216 hrs (%) | 0.136 | 0.163 | 0.095 | 0.074 | 0.059 | 0.099 | 0.137 | 0.149 | 0.037 | 0.045 | 0.1494 |
| SASH wt. % (calculated) | 0.81 | 0.82 | 0.85 | 0.77 | 1.33 | 0.98 | 0.76 | 1.04 | 1.07 | 0.96 | 0.45 |

As seen from inventive examples IE-1 through IE-3, the combination of a low total TBN of the lubricating oil composition with a low weight ratio of 10 or less for the ratio of the ppm of zinc from the zinc dithiophosphate(s) to the ppm of molybdenum from the molybdenum-containing compound(s) unexpectedly shows a reduction in chain stretch while maintaining a low sulfated ash content of the lubricating oil composition.

It is known that increasing the total TBN of the lubricating oil composition results in a reduction in chain stretch, as demonstrated in Comparative Examples CE-5 and CE-6. However, the present invention demonstrates that similar results can be achieved even when the total TBN of the lubricating oil composition is less than 7.5, by ensuring that the weight ratio of ppm zinc from the zinc dithiophosphate(s) to ppm of molybdenum from the molybdenum-containing compound(s) is less than 10.

Figure 3:
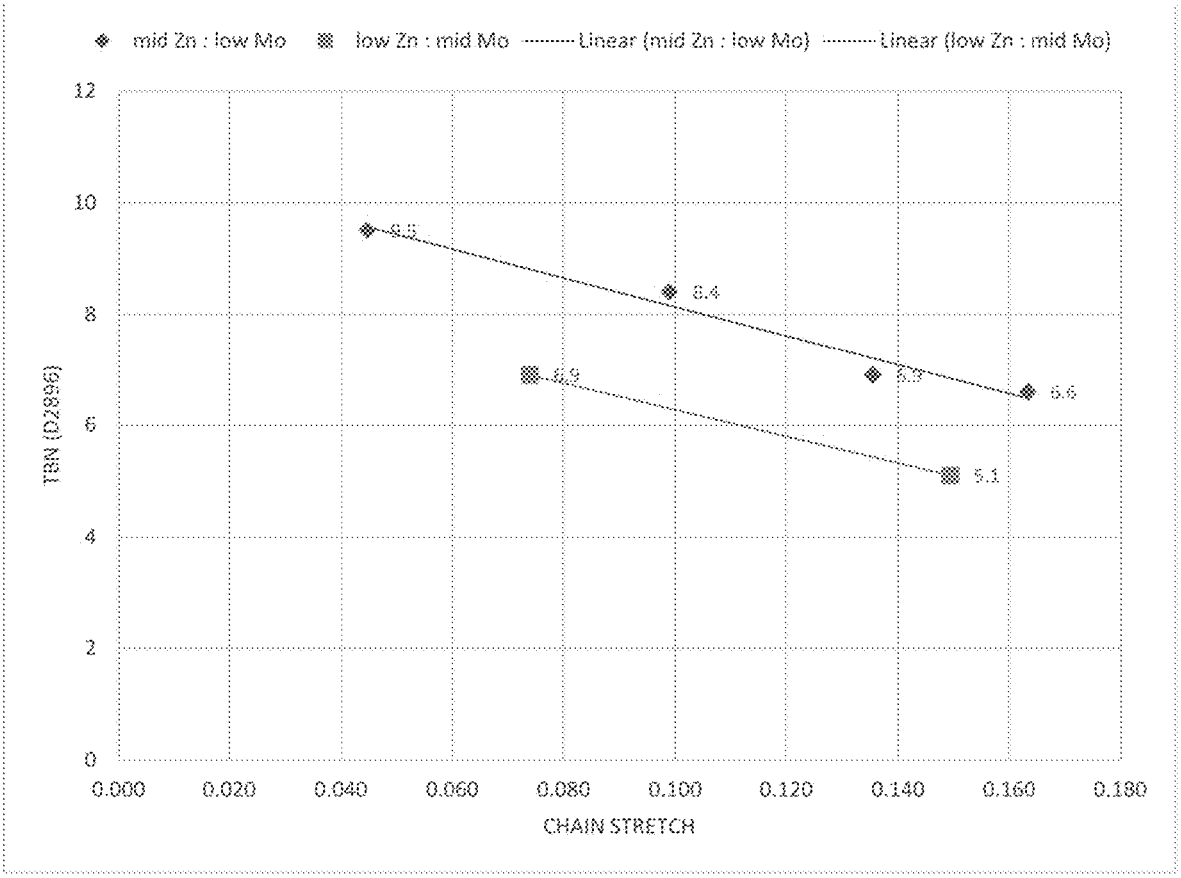
FIG. 3 is a graph showing the effects of TBN and the weight ratio of ppm of zinc from the one or more zinc dialkyl dithiophosphate(s) to the ppm of molybdenum from the one or more molybdenum-containing compound(s) on chain stretch for comparative examples CE-2, CE-3, CE6 and CE-7, and inventive example IE-1.

FIG. 3 is a graph showing the effects of a low weight ratio of ppm of zinc from the zinc dithiophosphate(s) to the ppm of molybdenum from the molybdenum-containing compound(s). The lubricating oil compositions of Comparative Example CE-1 and Inventive Example IE-1 had a total TBN value of 6.9 of the lubricating oil composition, and have weight ratios of the ppm zinc from the zinc dithiophosphate(s) to the ppm of molybdenum from the molybdenum-containing compounds of 33.9 and 4.0, respectively. However, as seen from Table 3 and FIG. 3, reducing the ppm zinc from the zinc dithiophosphate(s) to the ppm of molybdenum from the molybdenum-containing compounds from 33.9 to 4.0 provided a reduction in chain stretch from 0.136 to 0.074.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

It is to be understood that each component, compound, substituent or parameter disclosed herein is to be interpreted as being disclosed for use alone or in combination with one or more of each and every other component, compound, substituent or parameter disclosed herein.

It is also to be understood that each amount/value or range of amounts/values for each component, compound, substituent or parameter disclosed herein is to be interpreted as also being disclosed in combination with each amount/value or range of amounts/values disclosed for any other component(s), compounds(s), substituent(s) or parameter(s) disclosed herein and that any combination of amounts/values or ranges of amounts/values for two or more component(s), compounds(s), substituent(s) or parameters disclosed herein are thus also disclosed in combination with each other for the purposes of this description.

It is further understood that each range disclosed herein is to be interpreted as a disclosure of each specific value within the disclosed range that has the same number of significant digits. Thus, a range of from 1-4 is to be interpreted as an express disclosure of the values 1, 2, 3 and 4.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

Suitable modifications and adaptations of the variety of conditions and parameters normally encountered in the field, and which are obvious to those skilled in the art, are within the scope of the disclosure. All patents and publications cited herein are fully incorporated by reference herein in their entirety.

What is claimed is:

1. A lubricating oil composition comprising:

greater than 50 wt. % of a base oil, based on a total weight of the lubricating oil composition; and an additive composition comprising:

an amount of one or more zinc dialkyl dithiophosphate (s) sufficient to provide from about 350 ppm to about 2200 ppm zinc to the lubricating oil composition, based on the total weight of the lubricating oil composition, an amount of one or more molybdenum-containing compound(s) sufficient to provide greater than 1 ppm to about 3000 ppm of molybdenum to the lubricating oil composition, based on the total weight of the lubricating oil composition, one or more boron-containing dispersants(s), and an amount of one or more magnesium-containing detergent(s) sufficient to provide less than 2050 ppm magnesium to the lubricating oil composition, based on the total weight of the lubricating oil composition, wherein the lubricating oil composition has a total TBN of less than 7.5 mg KOH/g, as measured by the method of ASTM D-2896, a weight ratio of ppm of zinc from the one or more zinc dialkyl dithiophosphate(s) to ppm of molybdenum from the one or more molybdenum-containing compound(s), is less than 10, and a weight ratio of ppm of boron from the one or more boron-containing dispersant(s) to the total TBN of the lubricating oil composition in mg KOH/g of the lubricating oil composition, as measured by the method of ASTM D-2896, of from 32 to 36.

2. The lubricating oil composition of claim 1, wherein the lubricating oil composition has a total sulfated ash content of 2 wt. % or less, based on the total weight of the lubricating oil composition.

3. The lubricating oil composition of claim 1, wherein the weight ratio of ppm of zinc from the one or more zinc dialkyl dithiophosphate(s) to ppm of molybdenum from the one or more molybdenum-containing compound(s), is less than 6.

4. The lubricating oil composition of claim 1, wherein the one or more zinc dialkyl dithiophosphates comprises a first zinc dialkyl dithiophosphate derived from a primary alkyl alcohol and a second zinc dialkyl dithiophosphate derived from a secondary alkyl alcohol.

5. The lubricating oil composition of claim 1, wherein the one or more molybdenum-containing compound(s) comprises one or more compounds selected from sulfur-free organomolybdenum complexes of organic amides, molybdenum dithiocarbamates, molybdenum diothiophosphates and mixtures thereof.

6. The lubricating oil composition of claim 1, wherein the one or more molybdenum-containing compound(s) comprise a sulfur-free organomolybdenum complex of an organic amide.

7. The lubricating oil composition of claim 1, wherein the one or more molybdenum-containing compound(s) comprise a molybdenum dithiocarbamate.

8. The lubricating oil composition of claim 1, wherein the one or more magnesium-containing detergent(s) comprises an overbased magnesium-containing detergent having a total base number of greater than 225 mg KOH/g, as measured by the method of ASTM D-2896.

9. The lubricating oil composition of claim 1, wherein the one or more magnesium-containing detergent(s) comprises a detergent selected from magnesium sulfonate and magnesium phenate.

10. The lubricating oil composition of claim 1, wherein the one or more magnesium-containing detergent(s) is present in an amount sufficient to provide from 50 ppm to 1000 ppm magnesium to the lubricating oil composition, based on the total weight of the lubricating oil composition.

11. The lubricating oil composition of claim 1, further comprising one or more calcium-containing detergent(s) in an amount sufficient to provide from 500 ppm to 2000 ppm of calcium to the lubricating oil composition, based on the total weight of the lubricating oil composition.

12. The lubricating oil composition of claim 11, wherein the one or more calcium-containing detergent(s) is a calcium sulfonate detergent and excludes a calcium phenate detergent.

13. The lubricating oil composition of claim 1, wherein the one or more boron-containing dispersant(s) is present in an amount sufficient to to provide less than 250 ppm of boron to the lubricating oil composition, based on the total weight of the lubricating oil composition.

14. The lubricating oil composition of claim 1, wherein the lubricating oil composition further comprises one or more additives selected from the group consisting of antioxidants, friction modifiers, pour point depressants, and viscosity index improvers.

15. The lubricating oil composition of claim 1, wherein the base oil has a kinematic viscosity at 100° C. of from 3.8 cSt to 12 cSt, as measured according to ASTM-445-19.

16. The lubricating oil composition of claim 1, wherein the base oil has a kinematic viscosity at 100° C. of from about 5 cSt to about 10 cSt, as measured according to ASTM-445-19.

17. The lubricating oil composition of claim 1, wherein the lubricating oil composition is an engine oil composition.

18. The lubricating oil composition of claim 1, wherein the lubricating oil composition, when used to lubricate an engine, achieves a timing chain stretch in an engine of 0.1% or less, as measured by a Sequence X, Chain Wear Test of ASTM D8279.

19. A method for controlling timing chain stretch in an engine comprising a step of lubricating said timing chain with a lubricating oil composition comprising:

greater than 50 wt. % of a base oil, based on a total weight of the lubricating oil composition; and an additive composition comprising an amount of one or more zinc dialkyl dithiophosphate (s) sufficient to provide from about 350 ppm to about 2200 ppm zinc to the lubricating oil composition, based on the total weight of the lubricating oil composition, an amount of one or more molybdenum-containing compound(s) sufficient to provide greater than 1 ppm to about 3000 ppm of molybdenum to the lubricating oil composition, based on the total weight of the lubricating oil composition, an amount of one or more magnesium-containing detergent(s) sufficient to provide less than 2050 ppm magnesium to the lubricating oil composition, based on the total weight of the lubricating oil composition, and one or more boron-containing dispersants(s);

wherein the lubricating oil composition has a total TBN of less than 7.5 mg KOH/g, as measured by the method of ASTM D-2896, a weight ratio of ppm of zinc from the one or more zinc dialkyl dithiophosphate(s) to ppm of molybdenum from the one or more molybdenum-containing compound(s), is less than 10, a weight ratio of ppm of boron from the one or more boron-containing dispersants(s) to the total TBN of the lubricating oil composition in mg KOH/g of the lubricating oil composition, as measured by the method of ASTM D-2896, of from 32 to 36; and the lubricating oil composition achieves a timing chain stretch in an engine of 0.1% or less, as measured by the Sequence X Engine Test of ASTM D8279.

20. The method of claim 19, wherein the one or more calcium-containing detergent(s) comprise a calcium sulfonate detergent and excludes a calcium phenate detergent; or the one or more zinc dialkyl dithiophosphates comprises a first zinc dialkyl dithiophosphate derived from a primary alkyl alcohol and a second zinc dialkyl dithiophosphate derived from a secondary alkyl alcohol.

* * * * *